United States Patent [19]

Feldman

[11] 4,056,054

[45] Nov. 1, 1977

[54] CREDIT CARD IMPRINTER

[75] Inventor: Richard B. Feldman, San Mateo, Calif.

[73] Assignee: Chevron Research Company, San Francisco, Calif.

[21] Appl. No.: 715,808

[22] Filed: Aug. 19, 1976

[51] Int. Cl.[2] ..... B41F 3/04

[52] U.S. Cl. ..... 101/45; 101/269

[58] Field of Search ..... 101/45, 56, 269-274

[56] References Cited

U.S. PATENT DOCUMENTS

| | | | |
|---|---|---|---|
| 3,405,634 | 10/1968 | Mavl et al. | 101/45 |
| 3,515,060 | 6/1970 | Barbour | 101/45 |
| 3,722,405 | 3/1973 | Mahoney et al. | 101/45 |
| 3,826,190 | 7/1974 | Zofchak | 101/45 |
| 3,865,026 | 2/1975 | Trout | 101/45 |

*Primary Examiner*—Edward M. Coven

*Attorney, Agent, or Firm*—J. A. Buchanan, Jr.; R. L. Freeland, Jr.

[57] ABSTRACT

A credit card imprinter with a base for retaining the printing elements and transaction form. The imprinter includes a platen adapted to be moved from an initial position to an extreme position and back over the printing area on the base. Gear wheels are provided for positioning print wheels, and a stop means is provided to prevent movement of the platen to a movable mode until all the print wheels have been reset by actuation of a reset handle preceding a printing operation.

4 Claims, 4 Drawing Figures

CREDIT CARD IMPRINTER

BACKGROUND OF THE INVENTION

1. Field of the Invention

The invention relates to a variable data recording machine also referred to as a credit card imprinter. Such an apparatus has keys for setting data on imprint wheels for subsequent imprinting on a transaction form. The invention includes means for preventing recordation of data without first resetting all keys (and in turn all the imprint wheels) to a datum value.

2. Discussion of the Prior Art

The use of credit card imprinters is in widespread use by many retailing stores and outlets such as department stores and gasoline service stations. Such widespread use has been an incentive to develop various types of credit card imprinters.

Generally, these machines employ a platen which imprints data from an embossed credit card and adjustable data wheels onto a standardized transaction form. The data wheels, which may be in one or more sets, indicate the data, amount of the transaction, and other items such as store code, authenticating code and the like. The wheels that indicate the amount of the transaction must be reset after each transaction to prevent costly or embarrassing errors in subsequent transactions.

In one particular machine in common use today, there is means for preventing imprinting another transaction form unless at least one data key is reset, see U.S. Pat. No. 3,405,634. When this is done, the platen may again be moved over the standardized transaction form to imprint the new data. However, it has been my experience that oftentimes resetting one key will not assure that all the data keys will be properly reset to the value of another sale (because one or more keys may be inadvertently not reset). Consequently, inaccurate data is imprinted on the transaction form.

Such an error results in an improper value which is higher or lower than what the actual purchase is for and, as mentioned, may be the source of embarrassment and loss of business if so recorded. This is obviously undesirable, especially when one considers that the source of the problem is usually inadvertence. My invention, however, eliminates this problem by preventing the platen from being recycled from its initial position again over the printing area without first resetting all the keys.

SUMMARY OF THE INVENTION

To begin with, my invention is a credit card imprinter with a novel locking mechanism that prevents the movement of the platen so that it cannot be recycled through a printing operation (after once having been through one) without first resetting all the keys or data tabs at once. The invention provides a reset mechanism for the data keys and in turn the data wheels.

The credit card imprinter to which my invention adapts includes a movable platen with wheels which move on parallel paths above and below a base. This base has a printing area where a transaction form is imprinted and also has a plurality of data values (e.g., 0 to 9) printed on it in a plurality of rows. This portion of the base — with the plurality of data values — is referred to as the data key area.

The data tabs or keys pass through the base in the data key area so that each tab is respectively positionable next to a numerical value. In other words, the tabs are juxtapositionable along a decade of numerical values. These tabs are in operative association with a first set of intermeshing gears. And a second set of gears, which intermesh with the first set, are in operative association with a set of data wheels. These wheels are pivotally connected to the base and are engageable through a pinion (a gear with a small number of teeth to mesh with a larger gear) with the second set of gears. Thus, when the adjustable tabs are positioned alongside preselected numbers printed on the data key area, the same numerical value is positioned on the data wheel for imprinting on the transaction form.

The platen, mentioned above, has an upper portion and a bottom portion that extends below the base. The platen has wheels which move in parallel paths on both the top and bottom surfaces of the base. As the platen moves, it pressures the transaction form against the data wheels in order to imprint it with numerical values on the data wheels.

An extension of the bottom portion of the platen has a wheel connected to it which moves along an upper surface of an arm. This arm, which is pivotally connected to the base, actuates linkage and two pawls. (A pawl is a pivotable member adapted to fall between gear teeth to prevent gear movement). These pawls align and lock the gears as the platen travels over the printing area. This assures that each of the data wheels is in position to evenly and legibly imprint a single number on the transaction form (recording means). How this is done will be explained in more detail later.

The arm has a tang (a projecting prong or tongue) which engages another tang on the platen so as to stop the platen from moving or recycling over the printing area after once imprinting the transaction form. The arm is held in a stop position by a stop member. Initially it rotates as the platen moves over the printing area causing a pin or shaft to position between the teeth of the second set of gears. As this is done a detent spring is positioned which in conjunction with a detent plate and stop member holds the platen in a locked position. After the platen returns to its initial position and before it can be recycled over the printing area, the stop member is made recyclable again by resetting at least one of the data tabs which "kicks" or moves the roller in out from between the teeth gear.

However, with my invention all the keys are reset at once by the application of my money amount imprinter interlock kit. This kit includes:

a pair of substitute shafts that replace existing ones;
a pair of toggle arms;
a reset handle; and
may include a limiting lever and a return spring.

The manner these parts are installed and function to act as an interlock is set forth herein. To install the kit, the existing shaft and roller that extends through the detent plate is removed and replaced with a longer shaft without a roller. One end of this shaft is inserted in a slot of a toggle member. It is noted that in some cases, the existing shaft may have an extension portion mechanically coupled to it. This extension portion would then be inserted in the toggle member slot. A second toggle member is rotatably connected to another substitute or shaft that passes through and beyond the second set of gears. Likewise the portion that extends past the gears may be an extension (portion) mechanically coupled to the existing shaft.

A rod pivotally interconnects the second toggle member with a reset handle which is also rotatably connected to the base. The handle has a longitudinal member of sufficient length to extend behind all the data tabs. Thus when the handle is moved against the tabs, all of them are reset at once.

As this is being done, the force against the reset handle is transmitted through the rod which in turn transmits the force to the toggle arms. This causes the shaft to move while allowing the detent spring to reset. When the force against the reset handle is removed, the handle returns to its original position by the force of a reset spring that interconnects the toggle arms and the rod. It is noted this kit may be installed in the field at the location of an existing credit imprinter or at the factory on a new machine before it is ever put into operation. If my invention is secured at the factory to a new imprinter, the substitute shafts mentioned abofe may in fact be original components of the imprinter.

Besides these aspects and advantages of the invention, other ones will become apparent from the drawings, description of the preferred embodiment and the claims.

BRIEF DESCRIPTION OF THE DRAWINGS

FIG. 3 shows a cut away front view of an embodiment of the invention operatively connected to the imprinter.

DESCRIPTION OF THE PREFERRED EMBODIMENT

Figure 1:
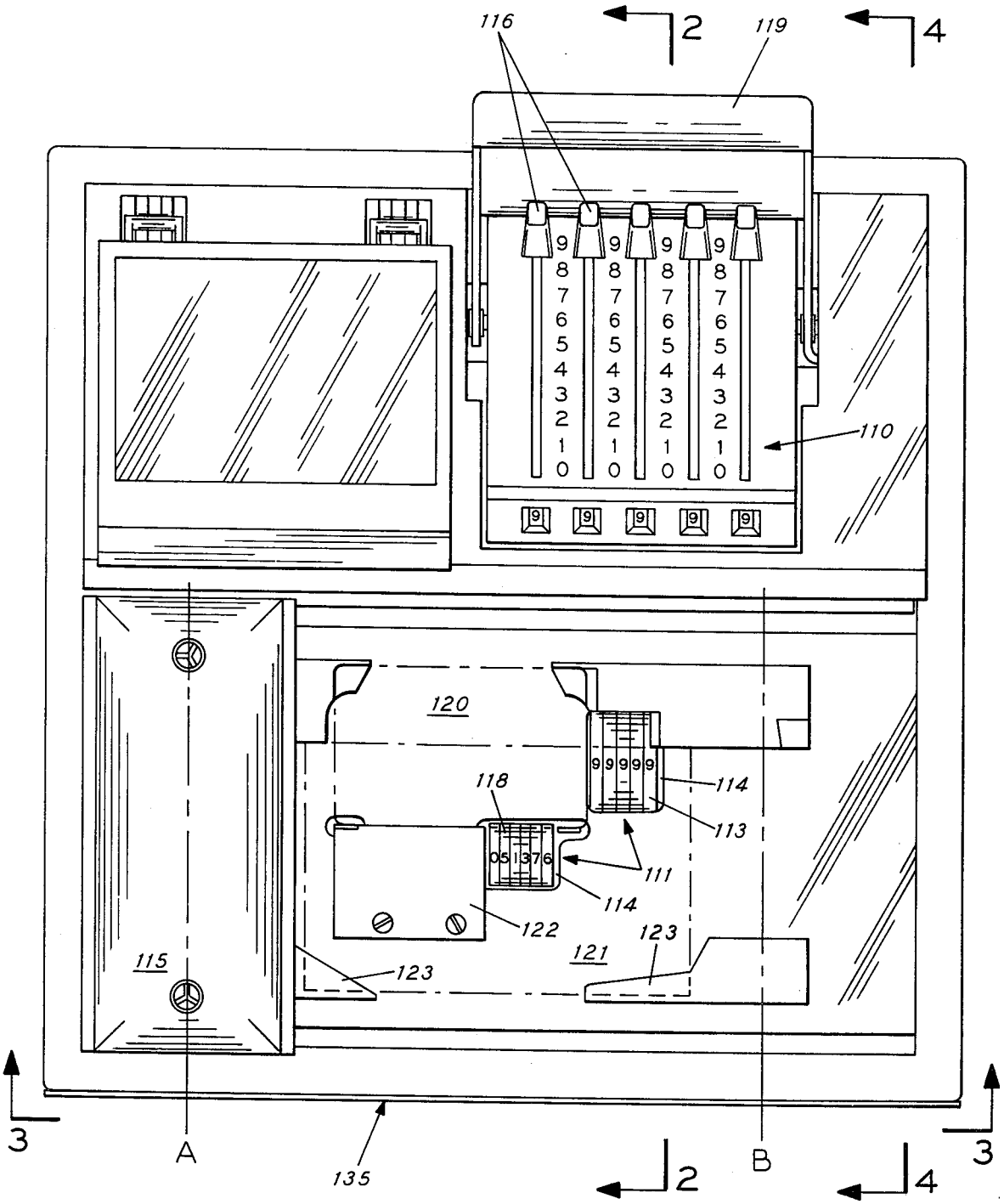
FIG. 1 is a plan view of a credit card imprinter to which a preferred embodiment of the invention is connected.

FIG. 1 illustrates a variable input data recorder (credit card imprinter) that includes data input means 110 and data recorder means 111. In this impriner, the data input means 110 is a keyboard in a fixed relationship to the data recorder means 111. The keyboard (also referred to as a data key area) is a series of keys or data tabs 116 in a plurality of rows for keyboard entry of dollar and cents values.

Specifically, FIG. 1 illustrates the keyboard as having five key paths — each path having a separate key position, within the path — next to any of the integers from 0 to 9. When the keys or data tabs 116 are moved, a given character or numerical value for reproduction corresponding to a numerical value alongside the key is in a position for subsequent imprinting a transaction form. Data recorder means 111 includes data wheels 113 which has numerical values or characteristics corresponding to the values or characters on the keyboard. Recorder means 111 also includes data wheels 118 which are manually set to give the date of the transaction.

Figure 2:
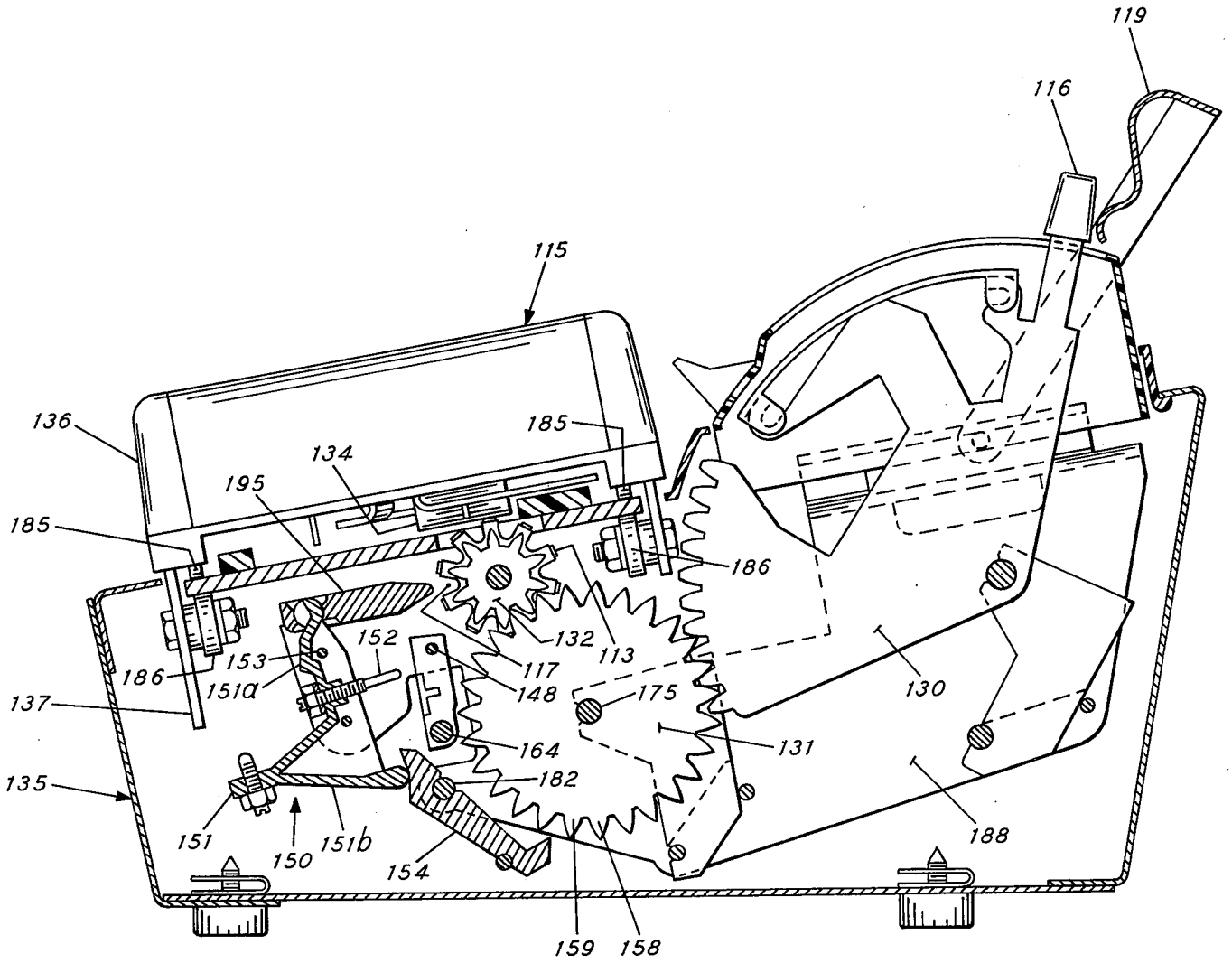
FIG. 2 is a cross section taken on line 2—2 of FIG. 1 which shows in detail the gearing needed to set data on the imprint wheels.

The imprinter as further shown in FIG. 2 includes a gear train of two sets of gears and pinion 132 which operatably intermesh each other so that when one of the keys is next to a value on the keyboard (data key area), the same value appears on the data wheel and extends through opening 114 as seen in FIG. 1 Movably connected to the recorder is platen 115. When the platen is moved across printing area 121 (FIG. 1), the numerical values on the data wheels are printed on a transaction form.

The imprinter operates as follows: An embossed data source card, commonly called a credit card, is placed within section numbered 120. Section 122 contains fixed information such as the name and location of the particular store or retail unit. A document or transaction form (such as one having a cardboard and one or more tissue copies with carbon paper between) is placed over printing surface area 121 where it is held in place by guides 123. Printing area 121 includes the fixed data information 122 and openings 114 for data wheels 113 and 118.

Now the variable information of the amount of sale is entered into data input means 110. This means, shown in FIG. 1, has five key or data tab paths and five character wheels — though any number of both may be provided. The key paths are arranged in a row and are able to record amounts up to $999.99; and the keys or data tabs are of such a shape and size that they may be located by a finger or a pencil. In the event that an error is made by the operator in entering the variable information, he merely resets them with handle 119 to a reference data value and begins over again. Alternatively, the keys may be reset individually.

After the variable input is set into the data input means 110, platen 115 is moved from an initial position A across the surface of the document to position B. This causes the values and information on the credit card and wheels to be permanently imprinted on the transaction form. Upon return of platen 115 to position A, the keys must be reset as further discussed below.

FIG. 2 shows the variable input data recorder or credit card imprinter similar to the one shown in FIG. 1. However, only one data wheel is illustrated to simplify the explanation of the operation of the invention. As indicated, keys 116 of the data input means are arranged in a key path and are juxtapositional to a given character for reproduction. FIG. 2 shows all the keys juxtaposition to "9". By moving the keys to this position, a first set of the intermeshing gears 130 rotate, causing a second set 131 to rotate, which in turn rotates the data wheels by rotating pinion gear 132 so that the value "9" is in the position shown. When this is accomplished and all of the other values are appropriately set on the data keys, the platen is ready to be moved over the printing area to imprint the transaction form, with the data exposed on the data wheels.

As mentioned earlier, platen 115 (FIGS. 2 and 3) includes a frame 133 and a printing roller platen 134, an upper portion 136, and a bottom portion 137 extending below base 135. In order for the platen to move, it has wheel sets 185, 186 which are connected to it and move respectively along the upper and lower portion of the base as the platen is moved across the printing area. A separate wheel 187 (FIG. 3) is pivotally connected to extension 137 of the platen and limits or determines the position of arm 140.

As platen 115 moves over the printing area, roller 187 begins to move to the right on the track provided by the lower surface of arm 140. The movement of the roller in the arcuate or curved section of the arm causes the arm to rotate counterclockwise as indicated by the phantom line configuration of the arm, see position C, FIG. 3. This in turn allows linkage 150 to move clockwise so that:

1. a plurality of pawls align and lock the data wheels that are operated by the keys; and 2. a pin is located to prevent the platen from recycling without resetting the keys.

On the return trip of the platen, roller 187 pivots the arm to position D which in turn pivots the tip of arm 140 against linkage 150 causing the linkage to pivot clockwise so that the data wheels are resettable and the platen is not recyclable without resetting them. Exactly how this is done will now be described.

Figure 3:
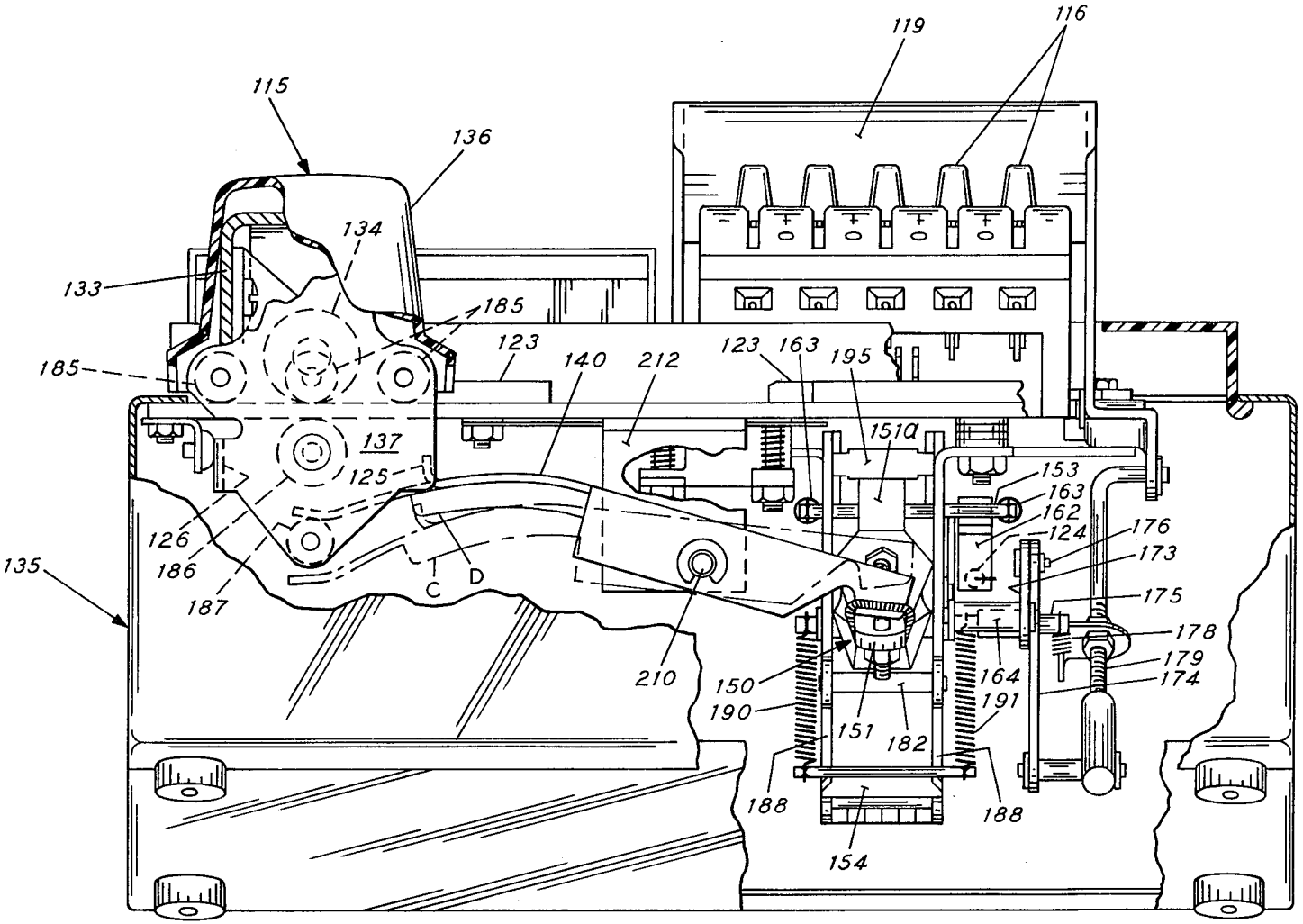
FIG. 3 is a partial cross section taken on line 3—3 of FIG. 1.

Arm 140, shown in FIG. 3, has a straight and arcuate (curved) section on which wheel 187 travels. This arm is pivotably connected to the base by pin 210 and bracket 212. When wheel 187 travels to the right, the arm rotates counterclockwise by the force of springs 163 to position C as shown by phantom lines in FIG. 3.

As arm 140 rotates, linkage 150 also rotates. This linkage (illustrated in FIG. 2) comprises rocker 151 which has two extensions 151*a*, 151*b*, an adjustable cyclindrical protrusion 152 and pin 153 passing through extension 151*a*. With the arm in position C, extension 151*b* of rocker 151 (rotably secured to the base between plates 188, FIG. 3) releases pawl 154 (FIGS. 2 and 4) to rotate about pin 182 (FIG. 3), as the tension in springs 190, 191 is released. This causes one end of pawl 154 to locate between teeth (e.g. 158, 159) of gear set 131. Consequently, the data exposed in opening 114 is aligned.

Figure 4:
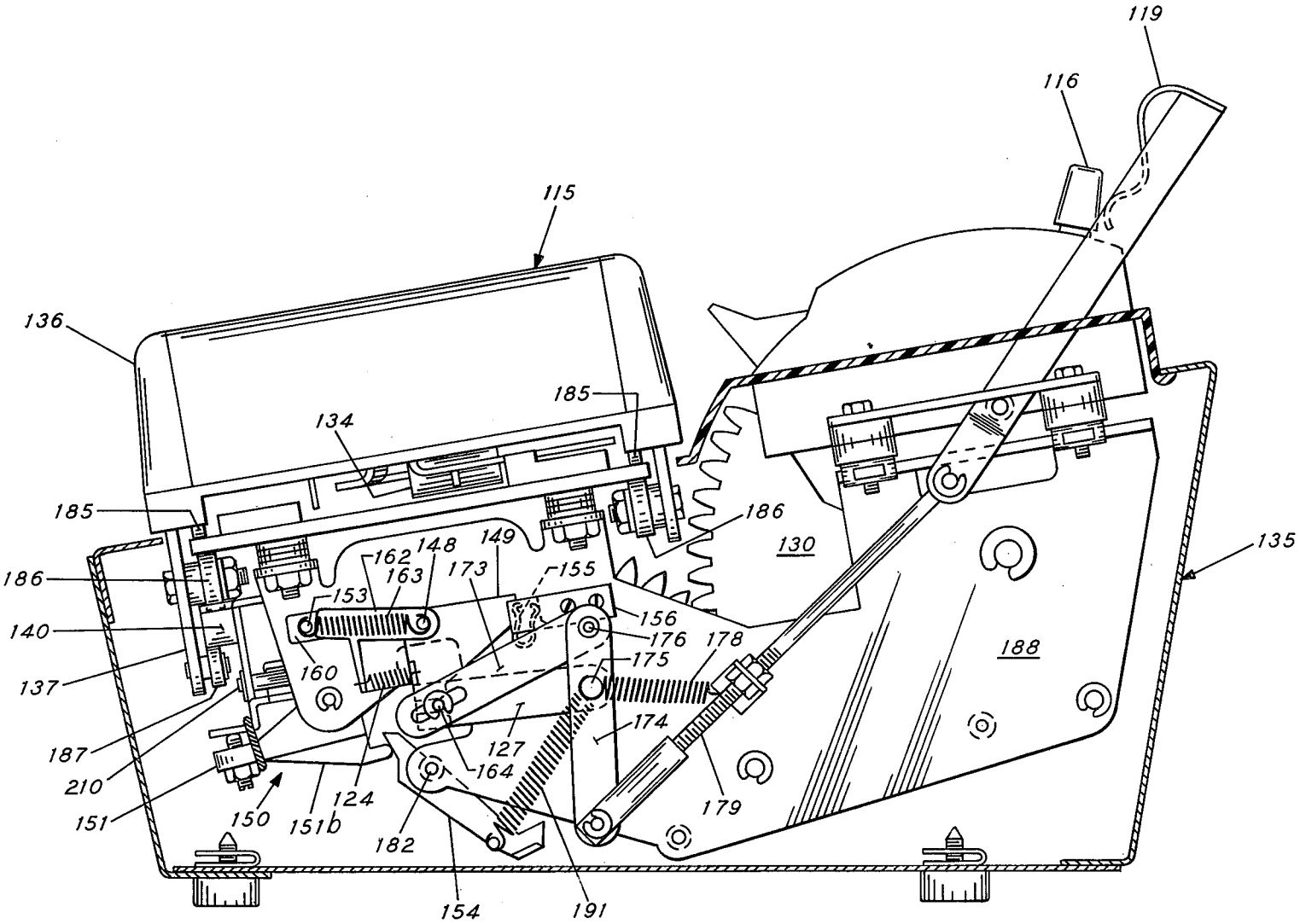
FIG. 4 is a cross section taken on line 4—4 of FIG. 1 which shows a side view of an embodiment of the invention operatively connected to the imprinter.

At about the same time, the rotation of extension 151*a* slides pawl 195 in slots 160 (FIG. 4) into notch 117 (FIG. 2) of data wheel 113. This locks the data wheels into their aligned position. The rotation of extension 151*a* also causes adjustable protrusion 152 to move against detent plate 149 (FIG. 4), which is secured to shaft or pin 164 that is pivotally connected between plates 188. Detent plate 149 is also interconnected to the pin 148 by springs 163. And as can be seen in FIG. 4, the detent plate has a notch which receives one end of detent spring 155; the other end of the detent spring is held by holder 156. Pivotally connected to the detent plate is a stopping means or member 162 (adjacent to the outer surface of the detent plate and slightly biased counterclockwise by spring 124 (FIG. 4).

As adjustable protrusion 152, FIG. 2, contacts detent plate 149, the detent plate itself rotates counterclockwise to position pin 164. The movement of the detent plate also moves the detent spring 155 so that it is acting upwardly to maintain the detent plate and pin 164 in its new position. At about the same time, pin 153 (in the extension 151*a*) moves under and along stopping member 162.

Now as the platen is returned to position A (FIG. 1), rocker 151 pivots in the opposite direction so that pin 153 moves from under the stop member into an effective stop position, FIG. 4. The other components, detent plate and pin 164 remain in their new position because of spring 155. Thus, if another cycle of the platen is attempted, pin 153 will strike the stopping member 162. This in turn prevents pivotal movement of rocker 151 and the spring induced motion of the rocker prevents arm 140 from rotating since, as shown in FIG. 3, tang 125 of arm 140 blocks tang 126 projecting from bottom portion 137 of the platen. It is noted that tang 125 may alternatively be referred to as the blocking means. These tangs come into contact with each other because arm 140 is unable to pivot out of the way of the platen's tang 126. Thus tang 125 blocks tang 126.

To explain how to make the imprinter recyclable, all the keys must be reset by the operation of reset handle 119 which is interconnected to pin 164. As shown in FIGS. 3 and 4, pin 164 is a dual diameter pin. The smaller diameter portion of pin 164 extends between plates 188. Its movement is limited by limiting lever 127 which may be pivotally secured at one end of shaft 175 with a slot at the other end so as to limit the extent of movement of pin 164. On the other hand, the absence of the limiting lever allows the in to fall between the teeth. It is noted that my invention can still work in this manner, though it may be a little harder to reset the keys because of the frictional resistance between the gears and pin.

The larger diameter portion of dual diameter pin 175 extends beyond the gears and engages the slotted portion of toggle arm 173 (FIG. 4), which is referred to in the claims as the second toggle arm. The larger diameter portion provides a shoulder that aids in retaining the second toggle arm. Nevertheless, other means known to those skilled in the art may be substituted in place of the larger diameter portion. For example, a notch may be fabricated in the pin for the slot to move in between two notches on each side of the toggle arm to receive clamp washers. The purpose of the slot in the second toggle member is to allow pin 164 to travel while also allowing reset handle 119 (described below) full travel to reset the keys prior to engaging pin 164.

Toggle arm 174 (referred to in the claims as the first toggle arm) is rotably held in position by an extension of shaft 175 to keep the first set of the gear in position. The end of this toggle member which is opposite toggle joint 176, is connected to rod 179, which is in turn pivotally connected to reset handle 119. The rod is also interconnected with the first toggle member through return spring 178. The function of the return spring is to force the reset handle back to its initial position when an actuating force which has been introduced to the handle has been removed. If the spring is not supplied, the reset arm must be manually returned to its initial position. Under normal operation, the actuating force would, of course, be the force introduced from the operator's hand.

Reset handle 119 is of sufficient length so that it extends behind all the data tabs or data keys. This allows all the data tabs and in turn the number wheels to be reset to a reference value, for example, zero. As this is occurring, force is transmitted from the reset handle through the toggle members which moves the dual diameter pin from its stop position so as to allow the detent plate and detent spring to move, which in turn allows the stopping member to be rocked up slightly. Then pin 153 moves under and along stop member 162. Tang 125 of arm 140 can now clear the platen's tang.

The reset handle, of course, is secured to the base so that it is pivotable at its secured points. As mentioned before, once this handle moves the data keys to the reference data value, the reset handle is returned to its initial position by the force transmitted from the return spring. The platen is now able to be relocated over the imprinting area so as to print a second set of values which have been reset on the imprinter. And then the reset process is repeated.

The foregoing describes a selected embodiment of the present invention in detail. The invention, however, is not to be limited to any specific embodiment, but rather only by the scope of the appended claims.

What is claimed is:

1. A credit imprinter adapted to prevent errors due to failure to reset said imprinter after a prior transaction, comprising:

a base including a first area for printing a transaction form and a second area having at least one row of data values printed thereon;

a platen, movable in a path across said base from an initial position to an extreme position and back to said initial position to form a printing cycle;

a platen roller rotatably supported by said platen;

a plurality of settable print wheels pivotally supported by said base and located in said printing area;

blocking means movable into the path of said platen so as to prevent movement of said platen to said extreme position;

stopping means controllably associated with said blocking means, said stopping means being movable to a first position to effect positioning of said blocking means in the path of said platen and to a second position to effect positioning of said blocking means out of the path of said platen;

means responsive to the motion of said platen through a printing cycle for moving said stopping means to said first position;

positioning means for setting each print wheel to a desired setting including a gear train having a set of gears which are pivotally connected to said base; and a first shaft which axially extends through each of said gears so as to pivotally support said gears to said base;

a second shaft movable to a stop position between adjacent teeth of each of said gears of said gear train while said stopping means remains in said first position and said platen remains in a locked position after said platen moved from initial position, across said printing area and returns to the initial position;

a pair of toggle arms having an interconnecting toggle joint wherein a first one of said toggle arms is pivotally connected to said first shaft for keeping said gears in axial alignment;

a second one of said toggle arms having a slot wherein said second shaft has one end slidably located therein;

a rod connected to one end to said pair of toggle arms so that substantially all of an actuating force which causes said rod to move is transferable to said pair of toggle arms which in turn moves said second shaft allowing said stopping means to move in said second position so as to permit said platen to be movable over said printing area;

a reset handle for introducing said actuating force, said handle rotatably connected to said rod and to said base, said handle for resetting all of said print wheels at once to a reference datum while said rod transfers a force through said toggle arm so as to relocate said second shaft from its stop position, permitting said platen to be relocated over said plurality of number wheels to record the data on said number wheels on another transaction form.

2. A credit card imprinter adapted to prevent errors due to failure to reset said imprinter after a prior transaction as set forth in claim 1 further comprising:

a means for limiting the travel of said second shaft so as to not engage adjacent teeth of said gears; and said limiting means movably connected at one end to said first shaft and slidably connected to said second shaft so as to limit travel of said second shaft between adjacent teeth of said gear set.

3. A credit card imprinter adapted to prevent errors due to failure to reset said imprinter after a prior transaction as set forth in claim 2 further comprising:

a return spring connected respectively at each end to said first shaft and said rod so that once the actuating force against said rod is removed, said spring returns said rod and said reset handle to their initial positions.

4. A money-amount imprinter interlock kit having components capable of being assembled where a credit card imprinter is located, said kit for providing an interlock to said imprinter, said imprinter having a base for holding a transaction form to be imprinted, a platen movable across said base from an initial position to an extreme position and back to its initial position to form a printing cycle, a platen roller rotatably connected to said platen, a plurality of settable print wheels pivotally connected to said base located so as to be able to be placed in printing cooperation with said platen, positioning means for setting each print wheel to a desired setting including:

a pinion associated with each print wheel and integral therewith, a gear wheel associated with each pinion and enmeshed therewith, a gear segment pivotally supported with and associated with each gear wheel and enmeshed therewith, a data tab secured to each of said gear segments so that when said tab is set said gear segment is moved which in turn moves an associated gear wheel and pin so as to set said associated print wheel;

a stopping means movable to a first position to prevent movement of said platen to said extreme position and to a second position which allows said platen to move to said extreme position, pawl means movable into engagement with said gear wheels for aligning said print wheels, rocker means for moving said pawl means into engagement with said pinions and said gear wheels in response to movement of said platen to said extreme position, and for moving said stopping means to said first position and said pawl means out of engagement with said pinions and said gear wheels in response to movement of said platen back to said initial position, a first pair of shafts, a first one of said shafts axially located and secured to said gear wheels whereby said first shaft is pivotally connected to said base, and a second one of said pair of shafts having a roller portion is movable over to a stop position between adjacent teeth of said gear wheels;

said kit comprising a combination of:

a substitute pair of shafts to replace respectively said first pair of shafts wherein a first substitute shaft of said substitute pair is axially located and secured to said gear wheels and has a portion that extends beyond said gear wheels so as to be usable as a pivot without interferring with said gear wheels, and a second substitute shaft having a portion that extends beyond said gear wheels so as to receive a force transmitted to it and is movable to stop position in front of said gear wheels;

limiting means pivotably connected to said base for limiting the travel of said second substitute shaft so that said second substitute shaft locates in front of the teeth of said gear wheels;

a pair of toggle arms so that a first toggle arm of said pair is pivotably connected to the portion of said first substitute shaft which extends beyond said gear wheels and wherein a second toggle arm of said pair has a slotted portion to accommodate slidable movement of the portion of said second substitute shaft which extends beyond said gear wheels;

a rod connected at one end to said pair of toggle arms so that actuating force is transmitted to said rod and transferred from said rod to said pairf of toggle arms which in turn moves said second substitute shaft so as to allow said stopping means to move to a said second position and which permits the movement of said platen to said extreme position;

a reset handle for introducing said actuating force to said rod, said handle rotatably connected to said base and pivotally connected to said rod, so that when said handle is moved to said actuating force said number wheels are reset to a reference value and said second substitute shaft becomes relocatable from a stop position, permitting said platen to be relocated to said extreme position; and a return spring connected at one end to said first substitute shaft and said rod so that once the actuating force is removed, said spring, said rod and said reset handle return to their respective initial positions.

* * * * *